US005255732A

United States Patent [19]

Vatant et al.

[11] Patent Number: 5,255,732

[45] Date of Patent: Oct. 26, 1993

[54] LOWER STRUCTURE OF A MOULD FOR THE PRESSURE CASTING OF FLAT PRODUCTS SUCH AS SLABS AND METHOD FOR MOUNTING AND REMOVING THE LOWER SPACER OF THIS MOULD

[75] Inventors: Robert A. Vatant, Saint-Chamond; Michel F. Courbier, Le Breuil; Luc H. Bertin, Saint-Chamond, all of France

[73] Assignees: Creusot-Loire Industrie, Puteaux; Clecim, Cergy Pontoise, both of France

[21] Appl. No.: 721,578

[22] PCT Filed: Jan. 15, 1990

[86] PCT No.: PCT/FR90/00027

§ 371 Date: Sep. 10, 1991

§ 102(e) Date: Sep. 10, 1991

[87] PCT Pub. No.: WO90/08000

PCT Pub. Date: Jul. 26, 1990

[30] Foreign Application Priority Data

Jan. 16, 1989 [FR] France ..... 89 00454

[51] Int. Cl.[5] ..... B22D 18/04

[52] U.S. Cl. ..... 164/306; 164/137; 164/271; 164/339; 249/80; 249/161

[58] Field of Search ..... 164/137, 47, 271, 342, 164/343, 119, 425, 306, 339; 249/79, 80, 134, 161

[56] References Cited

U.S. PATENT DOCUMENTS

| | | | |
|---|---|---|---|
| 3,340,926 | 9/1967 | Sylvester | 164/335 |
| 3,434,528 | 3/1969 | McGeeney | 164/341 |
| 3,590,904 | 7/1971 | Woodburn | 164/126 |
| 3,646,991 | 3/1972 | Jeffreys | 164/131 |
| 3,701,377 | 10/1972 | Fisher | 164/113 |
| 3,888,453 | 6/1975 | Jeffreys | 164/341 |
| 5,143,144 | 9/1992 | Laloi | 164/342 |
| 5,143,145 | 9/1992 | Vatant | 164/342 |

FOREIGN PATENT DOCUMENTS

| | | |
|---|---|---|
| 1608056 | 3/1967 | Fed. Rep. of Germany . |
| 62-142060 | 12/1987 | Japan . |
| 62-144861 | 12/1987 | Japan . |

*Primary Examiner*—Mark Rosenbaum
*Assistant Examiner*—Rex E. Pelto
*Attorney, Agent, or Firm*—Cushman, Darby & Cushman

[57] ABSTRACT

Lower structure of a mould for the pressure casting of flat products such as slabs and method for mount and removing the lower spacer of this mould is provided. The lower structure of the mould includes an intermediate beam (26) resting freely on a frame (3) whose upper surface opposite to its surface bearing on the frame (3) carries a lower spacer (4) which is fixed by clips (37) on the beam (26). At least one positioning pin (54) is engaged in a housing (55) at the front part of the frame (3). A plurality of members (47) for holding the intermediate beam (26) on the frame are distributed according to the length of the beam (26). These members each comprise a part (46) which can be engaged longitudinally in a coupling device (45) attached to the beam (26) and which can be actuated in order to hold the beam (26) on the frame (3) or, on the other hand, in order to release it. The device also includes a members for displacing the intermediate beam (26) relative to the frame (3) in a longitudinal direction over a distance which is sufficient to engage or release the pin (54) with or from housing (55) and the engagement parts (46) of the holding means (47) with or from the corresponding coupling devices (45).

10 Claims, 3 Drawing Sheets

LOWER STRUCTURE OF A MOULD FOR THE PRESSURE CASTING OF FLAT PRODUCTS SUCH AS SLABS AND METHOD FOR MOUNTING AND REMOVING THE LOWER SPACER OF THIS MOULD

The invention relates to a lower structure of a mould for the pressure casting of flat products of great thickness, such as slabs, and a method for mounting and removing the lower spacer of this mould.

A casting method which consists in introducing a ladle containing the metal to be cast inside a vessel which is then closed by a cover applied in a leaktight manner to the upper edge of the vessel has been known and used for a long time. The cover of the vessel carries a tube made from refractory material, the lower part of which is immersed in the metal filling the ladle and the upper part of which communicates with an opening which passes through the cover of the vessel equipped with means for connection to a spout for casting the metal in the mould.

The assembly consisting of the vessel containing the ladle and equipped with its closing cover can be brought into a casting position beneath a mould comprising a filling spout in its lower part. The spout for filling the mould is caused to coincide and to come into leaktight contact with the device for connecting the cover of the ladle, then, compressed air is conveyed inside the vessel so as to cause the metal to rise inside the refractory tube, then, inside the mould, until the latter is completely full.

By regulating the pressure of the gas conveyed in the ladle, the conditions for casting the metal and filling the mould are perfectly controlled, which makes it possible to obtain castings of a very satisfactory and uniform quality.

This pressure-casting method may be applied to the production of flat steel products of great thickness, such as slabs.

The moulds used for the pressure casting of slabs comprise a support and tilting frame mounted so as to pivot about a horizontal axis so that it may be inclined very slightly, relative to the horizontal plane, in order to connect the spout for filling the mould to the exit opening of the cover of the vessel before commencing the casting operation.

The mould principally comprises two lateral walls of large dimensions disposed parallel and opposite one another, the inner faces which are lined with graphite blocks of which form the surfaces of the mould which come into contact with the molten metal in order to delimit the two large faces of the slab.

The lateral walls are mounted on the frame so as to be movable in the direction perpendicular to their moulding faces, that is to say in the transverse direction of the mould corresponding to the thickness of the moulded product. The closing of the other faces of the cavity of the mould, of substantially parallel-epipedal form, is provided by spacers inserted between the two lateral walls which are clamped against these spacers during casting and cooling of the metal introduced into the mould.

The width of the spacers in the transverse direction determines the thickness of the flat product being cast.

A first spacer, or lower spacer, is fixed to the upper part of the support and tilting frame, partically over the entire length of this frame corresponding to the maximum length of the slab which can be cast in the mould.

In the known technique, the lower spacer is fixed directly to the frame of the mould by a series of fixing pieces, called clips, which are screwed onto the frame in lateral positions relative to the lower spacer and on each side of this spacer, each clip comprises an inner edge which bears on a corresponding lateral edge of the lower spacer. This mounting of the spacer on the frame permits certain longitudinal displacements of the spacer, through the action of thermal expansion, so that distortions or deformations of the lower spacer are avoided when the molten metal comes into contact with this spacer.

However, the thermal cycles to which the spacer is subjected during successive casts lead to deformations and to distortions such that the removal of the fixing clips becomes lengthy and difficult for the lower spacers after a certain time of use.

Changing the lower spacer, for example, in order to change the thickness of the mould thus requires a relatively long period in installations according to the known technique. This operation is performed over a period of the order of eight hours by a four-man team.

With the aim of improving the operating conditions of installations for the pressure casting of slabs, it is thus necessary to design a lower structure for the casting mould which makes it possible to simply and rapidly change the lower spacer.

The invention thus aims to propose a lower structure of a mould for pressure casting flat products of great thickness, such a slabs, comprising a longitudinal support and tilting frame carrying a lower spacer disposed according to the length of the frame, having a transverse dimension corresponding to the thickness of the slab and intended to form the lower closing wall of the cavity of the mould according to its entire length and to provide a space for the passage of the metal and the filling of the mould at its front part, the mould comprising three other spacers and two lateral walls which can be clamped against the spacers in order to close the cavity of the mould and the lower structure making it possible to rapidly and simply remove and replace the lower spacer, it also being possible for this lower structure to be cooled efficiently during casting of the metal.

To this end, the lower structure of the mould according to the invention comprises:

an intermediate beam resting freely on the frame, over a length corresponding substantially to the length of the lower spacer, the upper surface of which opposite to its surface bearing on the frame carries the lower spacer which is fixed on the intermediate beam with a certain possibility of longitudinal displacement through the action of thermal expansion, additional means on the front part of the intermediate beam and on the front part of the frame for positioning and holding the intermediate beam on the frame, a plurality of means for holding the intermediate beam on the frame distributed according to the length of the frame, each comprising a part which can be engaged longitudinally in a coupling device attached to the intermediate beam and which can be actuated in order to hold the beam on the frame or, on the other hand, in order to release it, and a means for the displacement and locking of the intermediate beam relative to the frame in the longitudinal direction connected to the beam in its front part in order to displace it over a distance which is sufficient to engage or release the additional means for positioning and holding the front part of the beam and the engagement parts of the holding means with or from the corresponding coupling devices.

The invention also relates to a method for removing and remounting a lower spacer of a mould for pressure casting slabs.

In order to make the invention easily understood, a description will now be given by way of non-limiting example, with reference to the appended figures, of an embodiment of a lower structure of a mould according to the invention and a method for mounting and removing the lower spacer of the mould.

FIG. 1 shows the assembly of a mould for the pressure casting of slabs denoted generally by the reference 1.

Figure 1:
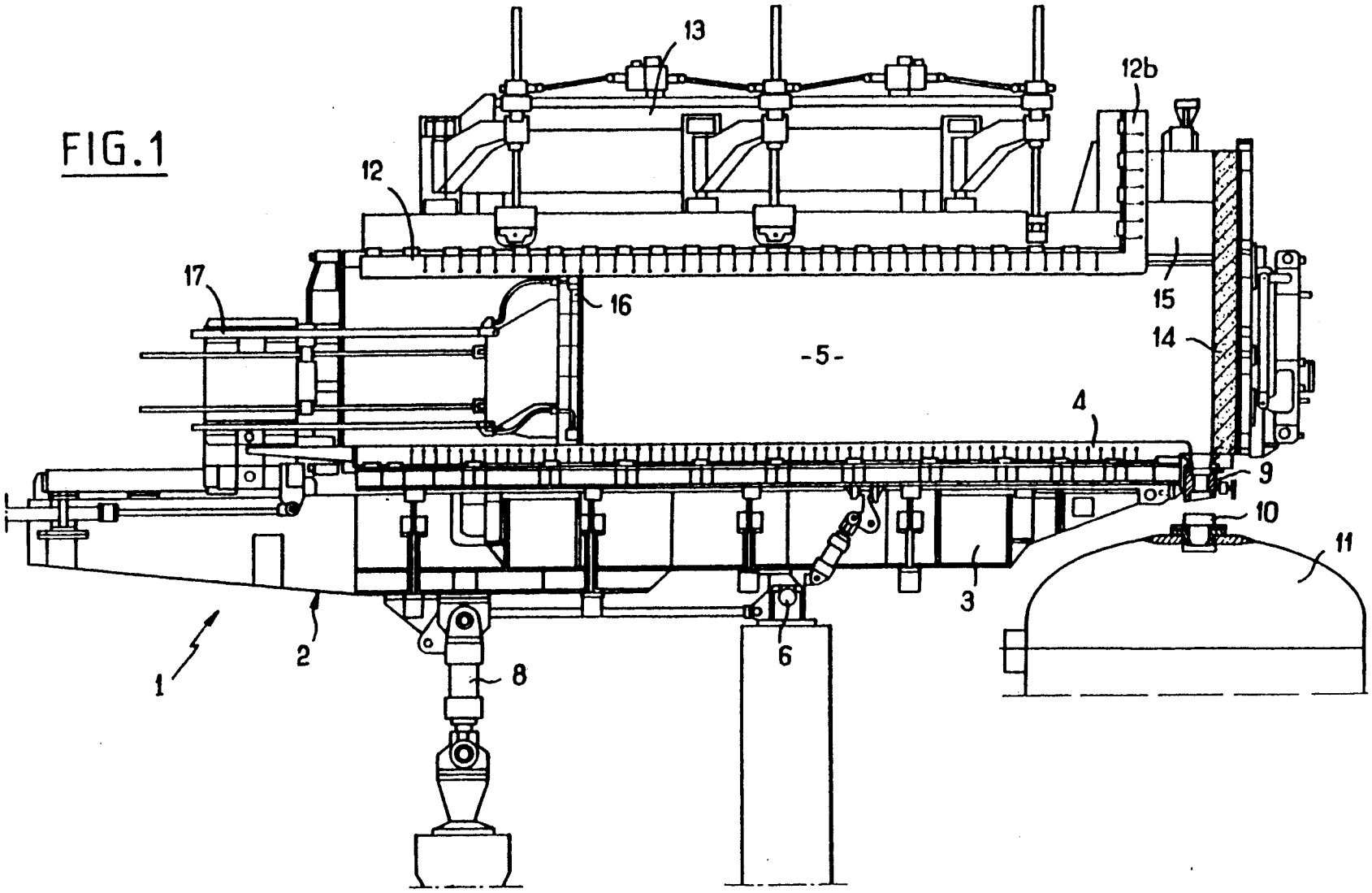
FIG. 1 is a schematic sectional view through a vertical plane of the assembly of a mould permitting the pressure casting of slabs.

This mould comprises a lower structure 2 consisting of a frame 3 and a lower spacer 4 fixed on the upper part of the frame 3.

The frame 3 forms an element for the support and tilting of the walls delimiting the moulding cavity 5 of the slab.

Moreover, the frame 3 is mounted so as to tilt about a horizontal shaft 6 located in the vicinity of the central part of the mould in the longitudinal direction corresponding to the longitudinal direction of the slab.

The mould 1 comprises a casting and filling spout 9 placed at one of the ends of the lower spacer 4 and of the frame 3 forming the front end of the mould.

A jack 8 makes it possible to tilt the mould 1 between a horizontal position in which the spout 9 is slightly above a connection device 10 fixed to the top of the cover 11 of the vessel of the pressure-casting installation and a position in which the mould is tilted forwards by a few degrees, the end of the casting and filling spout 9 then coming into leaktight contact with the connection means 10 fixed on the cover 11 of the vessel of the pressure-casting installation.

In this tilted position, the filling spout 9 is in communication with a tube fixed on the cover 11 of the vessel and which is immersed in a ladle of steel. By conveying air at a controlled pressure inside the vessel which is closed by the cover 11, the steel is caused to rise in the tube so that it progressively fills the cavity 5 of the mould by passing through the filling spout 9.

In addition to the lower structure 2 which will be described in more detail with reference to FIGS. 2 and 3, the casting mould 1 comprises an upper spacer 12 fixed to a suspension assembly 13 and held in a position which is substantially parallel to the lower spacer 4. The upper spacer 12 comprises an end front part 12*b* which is substantially vertical in the operating position of the spacer 12.

A front spacer 14 made from graphite is disposed vertically at the front of the mould so that its lower part delimits, with the front part of the lower spacer 4, a passage of a certain width for the molten metal communicating with the casting and filling spout 9 of the mould.

The upper part of the front spacer 14 delimits a riser 15 with the vertical front part of the upper spacer 12. The riser 15 connects the moulding cavity 5 with a header in which the metal shrinks at the end of casting.

The mould 1 also comprises a rear spacer 16 which can be displaced in the longitudinal direction by virtue of a device 17 fixed on the rear part of the support and tilting frame 3.

Two lateral walls are mounted so as to be movable in the transverse direction, that is to say in a direction perpendicular to the plane in FIG. 1, on the frame 3, so as to come into leaktight contact against the lateral faces of the spacers 4. 12, 14, 16, in order to ensure closing of the moulding cavity 5.

The lateral walls consist of graphite blocks which are juxtaposed and held in supports so as to form the inner moulding wall of the cavity 5, according to the large faces of the slab parallel to the plane in FIG. 1.

If it is desired to modify the thickness of the moulding cavity 5 in the transverse direction, in order to change the thickness of the slab, it is necessary to change all the spacers whose thickness in the transverse direction determines the thickness of the casting cavity 5 and of the slab.

Figure 2:
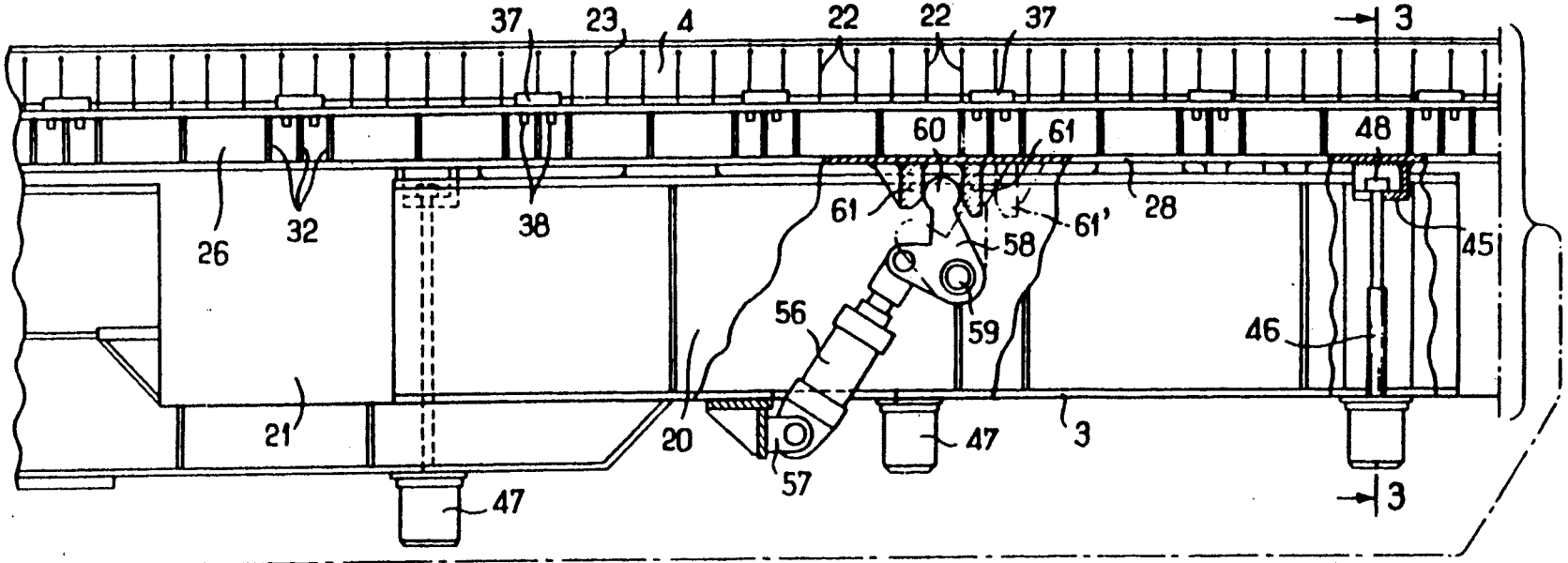
FIG. 2 is a schematic view in lateral elevation with tearing away and partial section of the lower structure of the casting mould shown in FIG. 1.
Figure 3:
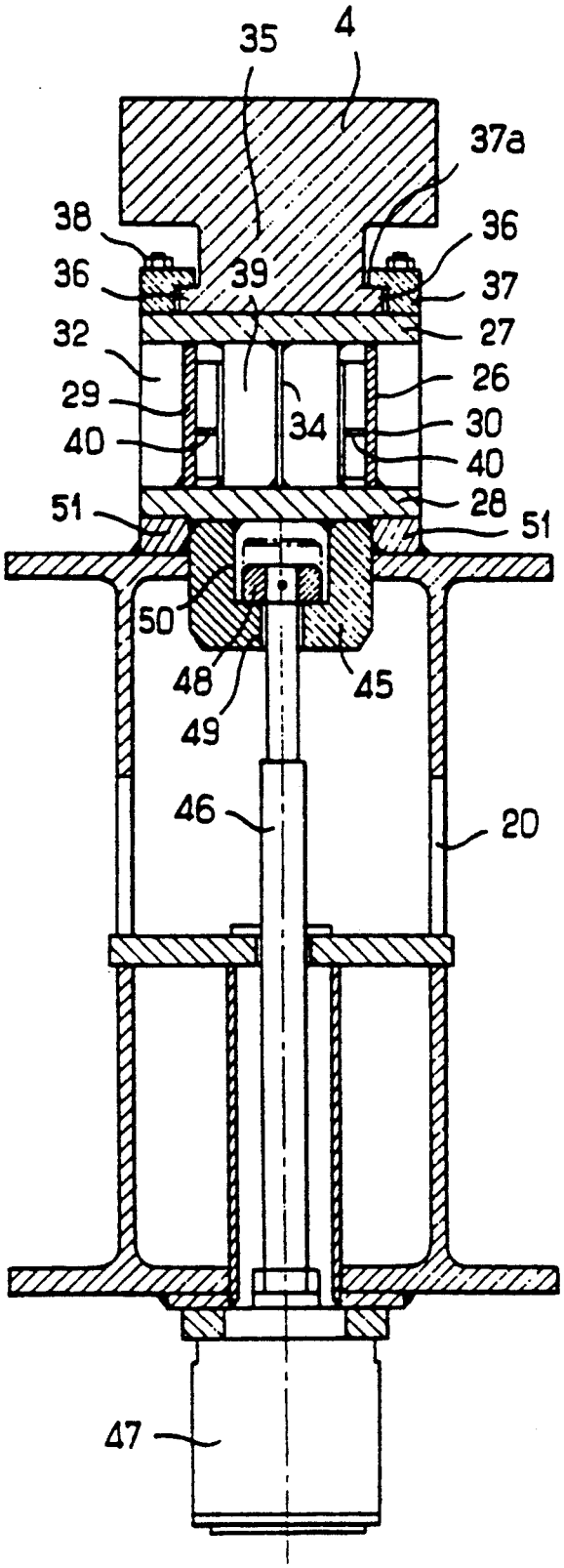
FIG. 3 is a sectional view through line 3—3 in FIG. 2.

FIGS. 2 and 3 show in more detail the lower structure 2 of the mould for the pressure casting of a slab, shown in FIG. 1.

The support and tilting frame 3 consists of metal sheets which are cut out and assembled by welding in order to form a structure of great rigidity comprising, in particular, a longitudinal member 20 supporting the mould over its entire length and the support and displacement device 17 of the rear spacer 16 on its rear part.

The support and tilting frame 3 also comprises elements 21, 21' disposed transversely and only the lower part of which, connected to the longitudinal member 20, has been shown in FIG. 2.

The lower spacer 4 consists of a profiled piece made from steel, of great length, the cross-section of the common part of which can be seen in FIG. 3. This piece of great length comprises cutouts 22 according to the cross-sections, between the lower face of the spacer and a hole 23 passing through the spacer over its entire thickness in the transverse direction, in the vicinity of its upper part. These cutouts make it possible to form successive sections in the lower spacer 4 whose longitudinal expansion, when the spacer comes into contact with the molten metal, is partially absorbed at the level of the transverse cutouts 22.

The front part or nose 4*a* of the lower spacer 4 has a rounded form in its part which comes into contact with the molten metal penetrating into the mould via the casting and filling spout 9. The nose 4*a* of the spacer 4 is cooled by the circulation of water in channels 25 of transverse direction, in the manner which will be described hereinbelow.

According to the invention and as may be seen in FIGS. 2 and 3, the spacer 4 is fixed on the upper part of the frame 3, by means of a beam 26 in the form of a caisson of rectangular cross-section, which will be denoted hereinafter as the intermediate beam.

The intermediate beam comprises an upper plate 27 and a lower plate 28 which are parallel to one another and disposed over the entire length of the beam 26. These plates 27 and 28 form the wings of the beam 26 whose web consists of two continuous parallel plates 29 and 30 connected by welding to the plates 27 and 28 and set back relative to the outer edge of these plates 27 and 28. Transverse reinforcement elements 32 welded on the plates 27 and 28 and distributed according to the length of these plates make it possible to increase the rigidity of the beam 26 and form spacers, in particular at the level of the zones for fixing the spacer 4 on the beam 26.

The spacer 4 comprises a lower part 35 which comprises two end parts 36 projecting outwards on which the edges 37*a* of clips 37 fixed by screws 38 on the upper plate 27 of the beam 26 are applied.

It is quite obvious that the upper part of the spacer 4 on the lateral faces of which the lateral walls of the mould are applied can have any width in the transverse direction, this width determining the thickness of the slab to be cast being totally independent of the transverse dimensions of the beam 26.

The beam 26 can thus be a totally standard element on which a spacer of desired width determining the thickness of the slab will be fixed by clips 37 according to the customary technique.

On the other hand, the lower part of the spacer 4 on which the edges 37*a* of the clips 37 are applied has a standard size ensuring its fixing on the beam 26.

As may be seen in FIG. 3, a longitudinal separation partition 34 is fixed to the central part of the beam 26, at an equal distance from the webs 28 and 29 so as to delimit two totally separate compartments over the entire length of the beam 26, inside the caisson formed by the wings 27 and 28 and the webs 29 and 30.

Moreover, the beam 26 comprises inner transverse spacers 39 comprising, on either side of the wall 34, lateral cutouts ensuring the placing in communication of the various parts of the compartments located on either side of the wall 34, according to the length of the beam 26.

Moreover, U-shaped profiles 40 are welded on the inner surface of the webs 26 and 29 in order to form channels for the circulation of water which are isolated relative to the remaining part of the compartments delimited by the wall 34 inside the box girder 26.

The box girder is closed at its front end by a transverse plate 42 closing each of the compartments of the caisson delimited by the wall 34 at its front end. The wall 34 provides a space permitting the passage of water relative to the wall 42 at its front end.

It is thus possible to cool the box girder 26 during casting by conveying cooling water into one of the compartments delimited by the wall 34, this water passing through the spacers 39 at the level of the lateral openings and circulating according to the entire length of the beam 26. At the closed front end of the beam 26, the cooling water passes into the second compartment in which it circulates in the opposite direction relative to its direction of circulation in the first compartment. It is thus possible to achieve efficient cooling of the intermediate beam 26 and, to a certain extent, of the spacer 4.

Cooling water is also conveyed via the rear end of the intermediate beam 26 into one of the circulation channels delimited by a U-shaped profile 40. This water circulates according to the entire length of the beam 26 and is then conveyed by means of two outer pipes 43, fixed in a leaktight manner to the end of the circulation channels delimited by the profiles 40 inside the box girder 26, to the cooling channels 25 of the front part of the spacer 4. Two other outer pipes identical to the pipes 43 collect the cooling water on the opposite face of the spacer 4 in order to convey it into the second channel delimited by the second profile 40. By means of an intense circulation of cooling water in the longitudinal channels of the beam 26 and in the cross channels 25 of the front part or nose of the spacer, it is thus possible to cool the part of this lower spacer 4 which comes into contact with the molten metal.

As may be seen in FIGS. 2 and 3, the lower wing 28 of the box girder 26 carries, on its inner surface, profiled pieces 45 in the form of a U, comprising a longitudinal slot in the shape of a T in which the end part of the rod 46 of a jack 47 is engaged. The bodies of the jacks 47 are fixed on the lower part of the frame 3 plumb with each of the profiled pieces 45 or thin strips in which the rod of the jack is engaged, when the beam 26 is in the operating position on the frame 3, as shown in FIGS. 2 and 3.

The rod 46 of the jack 47 comprises a widened part 48 which can consist of an attached piece, such as a nut or a ring fixed to the end of the rod 46. The diameter of the rod 46 is less than the width of the opening in the piece 45 in its narrowest part corresponding to the branch of the T. On the other hand, the widened part 48 fixed to the end of the rod 46 has a diameter of a width which is greater than the width of the part 49 of the opening of the piece 45. The dimension of the widened part 48 is, on the other hand, smaller than the width of the upper part 50 of the opening of the piece 45.

As may be seen in FIG. 2, several jacks 47 are fixed according to the length of the frame 3 and a piece 45 or thin strip is fixed to the lower wing 28 of the beam 26 plumb with each of the jacks 47. The thin strips 45 are welded to the lower surface of the wing 28 and pass through the upper part of the frame 3 at the level of a passage opening, on either side of which are welded wedges 51 permitting accurate positioning and regulation of the box girder 26 on the upper surface of the longitudinal member 20 of the frame 3.

Figure 2A:
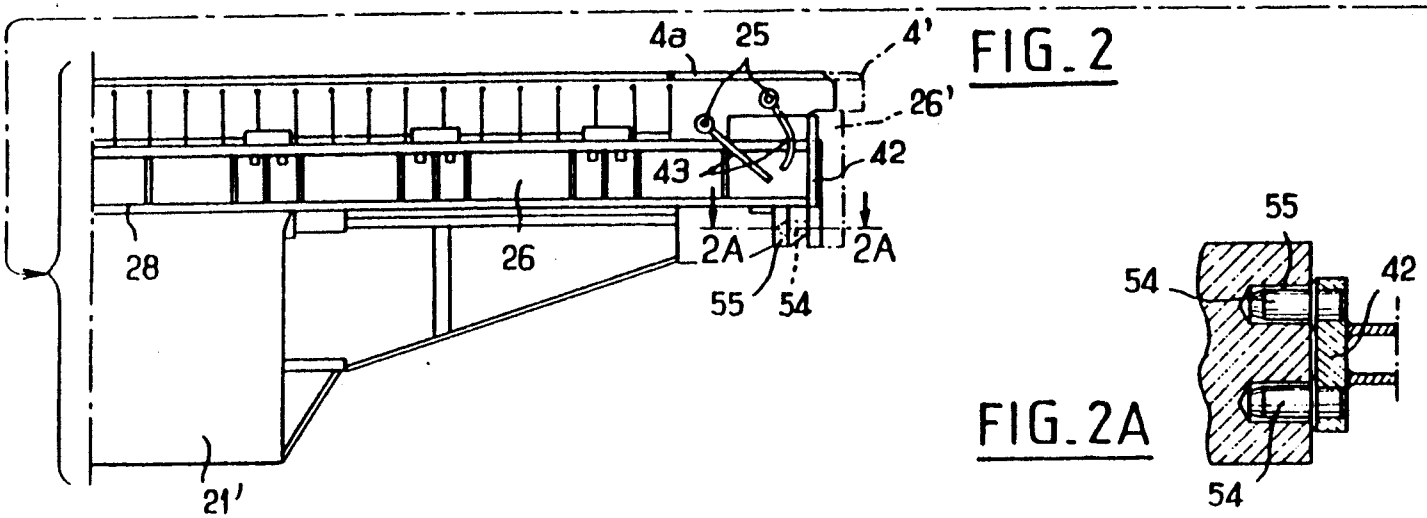
FIG. 2A is a sectional view through line 2A—2A in FIG. 2.

As may be seen in FIG. 2A, the closing plate 42 of the front part of the box girder 26 carries two positioning pins 54 which are engaged, when the beam 26 is in the operating position on the frame 3, in housings 55 made in the front end of the longitudinal member 20 of the frame 3.

Moreover, the body of a jack 56 is fixed in an articulated manner to a plate 57 integral with the lower end of the frame 3, the rod of the jack itself being articulated to the end of one of the branches of a bent lever 58.

The bent lever 58 is mounted in an articulated manner about a shaft 59 of transverse direction on the frame 3.

The second branch of the bent lever 58, forming an angle slightly less than 90° with the first branch articulated at the end of the rod of the jack 56, is formed as a pivot 60 inserted between two stops 61 carried by the lower plate 28 of the beam 26, in the front part of this beam.

It is quite obvious that, when the beam 26 is free in translation on the upper surface of the frame 3, the longitudinal displacement in translation of the beam 26 on the frame may be obtained by feeding the jack 56 so as to extract its rod attached to the end of the first branch of the lever 58. The lever 58 turns about its shaft 59 and the pivot 60 pushes the stop 61 into its position 61', which causes the displacement of the beam 26 and of the spacer 4 into their respective positions 26' and 4'. The device with the lever 58 and the pivot 60 is connected to the beam 26 in its front part, which makes it possible to avoid the drawbacks connected with the thermal expansion of the front part of the beam 26.

When the dual-action jack 56 is fed in the other direction, the retraction of its rod causes the rotation of the bent lever 58 in the opposite direction, which returns the beam 26 and the spacer 4 into their positions shown in solid lines in FIG. 2, by pushing on the second stop 61.

These displacements in translation of the box girder 26 and of the spacer 4 can be obtained when the traction jacks 47 are released, these jacks forming the only elements holding the beam 26 on the frame 3.

During the displacement in translation of the beam 26, the pieces 45 or thin strips, the slotted part 49 of which has a width which is greater than the diameter of the rod 46 of the jack, are displaced in translation relative to the jack rods which are themselves held in a fixed position in the frame 3.

The translation caused by the jack 56 and the bent lever 58 has sufficient amplitude to completely release the rods 46 of the jacks 47 from the thin strips 45. This translation is also sufficient to completely release the positioning pins 54 fixed to the end of the beam 46 (sic) from the housings 55 in the front end of the frame 3.

Translation in the other direction, that is to say towards the rear of the frame, conversely produces a reintroduction of the rods of the jacks into the thin strips 45 and of the pins 54 into the housings 55.

It is thus quite obvious that the mounting or removal of the lower spacer can be performed very rapidly, by means of simple actuation of the jacks 47 and then of the jack 56 in order to cause the translation of the assembly formed by the box girder and the lower spacer.

In order to remove a spacer, it is sufficient to release the jacks 47 which hold the beam 26 and whose geometric arrangement and relative dimensions make it possible to reduce and even to cancel out the thermal deformation of the beam 26 due to the temperature gradients between its lower face and its upper face in contact with the spacer 4.

When the rods of the jacks 47 no longer exert traction on the beam 26 by means of the thin strips 45, the beam 26 is free in longitudinal translation and may be displaced by feeding the jack 56 in order to completely release the rods of the jacks from the thin strips 45 and the pins 54 from the housings 55.

The assembly consisting of the beam 26 and the spacer 4 is then completely separated from the frame 3 and may be lifted off, for example by using a travelling crane.

A new assembly consisting of an intermediate beam and a spacer, for example of a different size in order to change the thickness of the moulding cavity, is brought into position by the travelling crane above the frame 3.

During positioning of the beam 26 on the frame 3, it is simply necessary to ensure that the thin strips 45 are in a correct transverse position in order to be introduced into the housings provided in the upper part of the longitudinal member 20 of the frame 3 and that the housing of the pivot 60 between the stops 61 of the beam 26 is placed in a correct position relative to the end of the lever consisting of the pivot 60.

It then suffices to actuate the jack 56 in order to produce a translation towards the rear of the assembly consisting of the beam 26 and the spacer 4, in order to reintroduce the ends of the rods of the jacks 47 into the openings of the thin strips 45 and the pins 54 into the housings 55.

The desired pressure is then applied in the holding jacks 47 which, via traction by means of their rod 46 and of the thin strips 45, hold the intermediate beam 26 on the upper part of the frame 3.

The spacer 4 of desired width which is fixed on the upper part of the beam 26 by virtue of the clips 37 is then in place and can undergo certain longitudinal deformations relative to the beam 26 during the cast, by virtue of this method of fixing.

All the operations for the positioning and locking may be controlled remotely, only the precise transverse positioning of the thin strips and the longitudinal positioning of the stops 61 having to be controlled by an operator working near the installation.

Moreover, as has been explained hereinabove, the caisson structure of the beam permits cooling of this beam and feeding of the cooling channels of the nose of the lower spacer.

The invention is not limited to the embodiments which have been described.

Thus, the jacks 47 for holding the intermediate beam on the frame may consist equally of screw jacks or of hydraulic jacks.

The translation device may be of a type other than that described, which comprises a hydraulic jack and a bent lever.

The joint between the ends of the rods 46 of the jacks 47 and the beam 26 may be produced by pieces with a form which is different from the thin strips 45, since the ends of the rods may be slid by axial translation into a zone of the joining pieces which makes it possible to exert a perpendicular traction on the surface of the frame.

The box girder may have a structure other than that which has been described and the cooling means associated with this beam may have various embodiments.

The invention is applied to the casting of slabs of all sizes in a pressure-casting installation.

We claim:

1. A lower structure of a mould for pressure casting thick flat products, the mould including three spacers, said structure comprising:

a longitudinal support;

a lower spacer disposed on said support, said lower spacer having a transverse dimension corresponding to a thickness of the flat product, said lower spacer defining a lower closing wall of a mould cavity and cooperating with said three spacers to define limits of the mould cavity, said lower spacer defining a passage at a front part thereof, said passage permitting metal therethrough for filling said mould cavity;

an intermediate beam member having first surface resting on said support over a length corresponding substantially to the length of said lower spacer, a surface of said beam member opposite said first surface carrying said lower spacer;

means for positioning said intermediate beam on said support disposed on a front portion of each said intermediate beam and said support;

means for releasably holding the intermediate beam on said support, said holding means being distributed over the length of said support, said holding means permitting said intermediate beam to be held on and released from said support; and means for displacing the intermediate beam relative to said support in the longitudinal direction, said displacing means being connected to said front portion of said intermediate beam permitting said intermediate beam to be displaced so as to engage or release said positioning means with or from said holding means.

2. The lower structure according to claim 1, wherein said holding means includes a jack having a body fixed on the support, said jack having a traction rod affixed at the first end thereof and being substantially perpendicular to said intermediate beam, a second end of said rod having a wide portion, said wide portion being disposed in an opening defined in a traction piece, said traction piece being attached to said intermediate beam in a longitudinal direction relative to said intermediate beam, said traction piece having a longitudinal slot having a width greater than a diameter of said rod and less than a diameter of said wide portion.

3. The lower structure according to claim 2, wherein the jack is a hydraulic jack.

4. The lower structure according to claim 2, wherein the jack is a screw jack.

5. The lower structure according to claim 1, wherein the positioning means includes at least one pin projecting rearwardly in the longitudinal direction and fixed on the front part of the support and of a longitudinal housing of corresponding form in the front part of the support.

6. The lower structure according to claim 1, wherein the displacing means includes a lever articulated on the support having two branches disposed at an angle, one of said branches being connected to the rod of a jack whose body is articulated on the support and the other branch having, at an end thereof, in actuating part inserted between two stops attached to said intermediate beam and spaced according to the longitudinal direction.

7. The lower structure according to claim 1, wherein the lower spacer is fixed on the intermediate beam by fixing pieces screwed onto the intermediate beam and having an inner edge bearing on a lateral edge of the lower spacer.

8. The lower structure according to claim 1, wherein an inner wall delimits, inside the intermediate beam, channels for the longitudinal circulation of water for cooling the intermediate beam, said channels being separated from one another over their entire length and placed in communication at the front part of the beam and being closed by a plate.

9. The lower structure according to claim 8, wherein said channels are fed with cooling water by means of two longitudinal channels delimited by profiles inside the intermediate beam and by pipes disposed outside said beam and connected in a leaktight manner to an end of the longitudinal channels delimited by the profiles and to the cooling channels of the front part of the spacer.

10. A method for mounting and removing a lower space of a mould for pressure casting of slabs, comprising the steps of:

fixing the lower spacer on an intermediate beam, said beam being fixed on a mould frame;

permitting a predetermined longitudinal displacement of said spacer relative to said intermediate beam;

providing means for holding the intermediate beam on said frame;

translating said intermediate beam and said lower spacer in a rearward longitudinal direction so as to engage said holding means with corresponding coupling parts that are attached to said intermediate beam, said translation causing said holding means to be actuated so as to hold and clamp the intermediate beam against the frame; and actuating said holding means to release the intermediate beam by translating the beam in a forward longitudinal direction to release said holding means from said coupling parts, thereby removing the lower space.

* * * * *